US007942501B2

(12) United States Patent
Van Lierop et al.

(10) Patent No.: US 7,942,501 B2
(45) Date of Patent: May 17, 2011

(54) ELECTROSTATIC ACTUATOR FOR INK JET HEADS

(75) Inventors: Hendrikus Wilhelmus Leonardus Antonius Maria Van Lierop, Eindhoven (NL); Antonius Johannes Maria Nellissen, Eindhoven (NL); Hermanus Mathias Joannes Rene Soemers, Eindhoven (NL); Johannes Antonius Theodorus Gollatz, Roermond (NL); Hans Reinten, Velden (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 100 days.

(21) Appl. No.: 12/301,303

(22) PCT Filed: May 9, 2007

(86) PCT No.: PCT/IB2007/051740

§ 371 (c)(1), (2), (4) Date: Nov. 18, 2008

(87) PCT Pub. No.: WO2007/135595

PCT Pub. Date: Nov. 29, 2007

(65) Prior Publication Data

US 2010/0053271 A1 Mar. 4, 2010

(30) Foreign Application Priority Data

May 19, 2006 (EP) ..... 06114190

(51) Int. Cl.
*B41J 2/04* (2006.01)

(52) U.S. Cl. ..... 347/54; 347/71

(58) Field of Classification Search ..... 347/40, 347/43, 54, 64–65, 68, 70–71, 47
See application file for complete search history.

(56) References Cited

U.S. PATENT DOCUMENTS

| | | | | |
|---|---|---|---|---|
| 5,734,395 | A | 3/1998 | Kamishuki et al. | |
| 5,751,314 | A * | 5/1998 | Takemura et al. | 347/55 |
| 6,491,833 | B1 * | 12/2002 | Silverbrook | 216/27 |
| 7,105,131 | B2 * | 9/2006 | Hilton | 422/100 |
| 2004/0046837 | A1 | 3/2004 | Hilton | |
| 2005/0046674 | A1 | 3/2005 | Silverbrook | |

FOREIGN PATENT DOCUMENTS

| | | | |
|---|---|---|---|
| EP | 1193064 | A1 | 4/2002 |
| EP | 1199174 | A1 | 4/2002 |
| EP | 1232866 | A1 | 8/2002 |
| EP | 1354706 | A1 | 10/2003 |

* cited by examiner

*Primary Examiner* — Lamson D Nguyen
(74) *Attorney, Agent, or Firm* — Larry Liberchuk

(57) ABSTRACT

An electrostatic inkjet head providing high pressure to ink in order to enable high quality printing. The electrostatic actuator providing the pressure to the membrane (200) compressing the ink in a chamber (50) with an opening (20) is characterized by an overlapping area of the actuation electrode (300) and the moveable electrode (500) not determined by the area of the membrane (200) covering the chamber (50) with the ink. The maximum pressure that can be applied can be adapted by means of the ratio of the overlapping area (220) of the two electrodes and the area (210) of the membrane (200) covering the chamber (50) with the ink. Use of said head to eject a liquid drug used in an injection system.

10 Claims, 17 Drawing Sheets

ELECTROSTATIC ACTUATOR FOR INK JET HEADS

The present invention is related to electrostatic actuators especially for ink jet heads.

Electrostatic actuators for ink jet heads are described in U.S. Pat. No. 5,734,395. A gap-closing type of electrostatic actuator as depicted in U.S. Pat. No. 5,734,395 has two electrodes in proximity to each other. One electrode is stationary while the other building the diaphragm covering one side of the ejection chamber of the print head can translate or bend. Applying a difference in electrical potential U between the electrodes will result in an electric field and hence an attractive pressure P, which can be used to move a load. Due to the fact that the area of the diaphragm covering the ejection chamber of the print head limits the effective area of the electrostatic actuator, the maximum pressure P that can be applied by this kind of electrostatic actuator can be calculated by means of $P=1/2\in_0\in_r E^2$. The pressure is therefore determined by the strength of the electrical field E and the relative permittivity $\in_r$ of the material in between the electrodes (e.g. vacuum, a gas, a fluid or a solid yet compressible material). The electrical field is limited due to breakdown phenomena; using common semiconductor and MEMS materials electrical fields in the range of 75-150 V/μm can be realized, resulting in an electrostatic pressure of 0.25-1 bar. This is insufficient for high quality ink jet printing.

It is an objective of the present invention to provide an improved electrostatic actuator for high-pressure ejection.

The objective is achieved by means of an electrostatic actuator, comprising a chamber with at least one opening on at least one side of the chamber, a flexible membrane being part of the boundary of the chamber, at least one actuation electrode, at least one moveable electrode, a pressure applicator coupling the movement of the flexible membrane and the moveable electrode, and a voltage supply to apply a voltage between the actuation electrode and the moveable electrode. The flexible membrane covers e.g. one side of the chamber and the actuation electrode is placed on the side where the membrane covers the chamber. The actuation electrode is directly or indirectly attached to the chamber walls being in a fixed position with respect to the chamber walls throughout operation of the electrostatic actuator. The pressure applicator is directly or indirectly attached to at least a part of the flexible membrane covering the chamber and to the moveable electrode. A first physical entity is directly attached to another second physical entity if at least parts of the first physical entity are directly connected to the second physical entity. If there is at least one intermediate layer between the first physical entity and the second physical entity both are indirectly attached to each other. At least a part of the moveable electrode faces the actuation electrode and the electrodes are essentially parallel to each other. If a voltage is applied between the moveable electrode and the fixed actuation electrode the electrostatic actuation of the moveable electrode is coupled to the flexible membrane. The flexible membrane starts moving inside the volume of the chamber. If there is fluid to be ejected filled in the chamber, the flexible membrane exerts pressure on the fluid to be ejected. The pressure in the chamber causes the ejection of the fluid to be ejected through the opening. The fluid to be ejected can e.g. be filled in the chamber by means of a second opening of the chamber connected to a reservoir filled with the fluid to be ejected by means of a tube. The fluid to be ejected is ejected during the application of the voltage between the moveable electrode and the actuation electrode enabling an improved control of the droplet dynamics by means of tailoring the voltage pulse applied by the voltage supply. This is advantageous in comparison to prior art where the fluid to be ejected is ejected when no voltage is applied to the electrostatic actuator.

In a preferred embodiment of the current invention the electrostatic active area of the moveable electrode is bigger than the part of the area of the membrane being part of the boundary of the chamber. The electrostatic active area of the moveable electrode is defined by the part of the moveable electrode directly facing the actuation electrode, whereby both electrodes are essentially parallel to each other. The pressure that can be applied by the electrostatic actuator is not limited by the area of the membrane covering the chamber as in the prior art. The pressure is essentially determined by means of the ratio A1/A2 between electrostatic active area A1 of the the moveable electrode and the area A2 of the part of the membrane covering the chamber, besides the electrical field resulting from the applied voltage and the permittivity of a material placed between the actuation electrode and the moveable electrode.

One possibility to configure the actuating element of the electrostatic actuator is to arrange the actuation electrode and the moveable electrode in a way that both are separated by means of vacuum, gas or a liquid dielectric. The gas or the liquid dielectric can enhance the pressure in comparison to vacuum if they are characterized by a permittivity higher than one. In this configuration the separation of the electrodes has to be controlled in a very accurate way in order to prevent a short circuit. In general several parameters have to be adapted in order to prevent short circuits:

- voltage applied between the moveable electrode and the actuation electrode
- distance between the moveable electrode and the actuation electrode
- stiffness and size of the flexible membrane where the pressure applicator is attached to
- stiffness and size of the pressure applicator
- stiffness and size of the moveable electrode if it is directly attached to the pressure applicator
- or stiffness and size of the substrate where the moveable electrode is placed on A method to limit the danger of short circuits is a dielectric material placed between the actuation electrode and the moveable electrode. The dielectric material can be placed directly on the actuation electrode or the moveable electrode or on both electrodes. The thickness of the layer of dielectric material and the electrical field of the dielectric material where electric breakdown occurs determine the maximum voltage that can be applied to the actuation electrode and the moveable electrode. As in the configuration without the dielectric material the volume between the actuation electrode and the moveable electrode if no voltage is applied can be vacuum or filled with gas or liquid. The attractive force between the actuation electrode and the moveable electrode can be enhanced if the volume between the actuation electrode and the moveable electrode is filled with gas or liquid characterized by a permittivity higher than one. If a liquid is used one has to be aware of the incompressibility of the liquid resulting in the need of extra volume filled with a compressible material (preferably gas) where the liquid can flow to if a voltage is applied to the actuation electrode and the moveable electrode and the volume between both electrodes is reduced.

In a further embodiment the actuation electrode extends at least partly above the flexible membrane covering the chamber on one side of the chamber. The actuation electrode can even extend above the whole flexible membrane being a part of the membrane if there is an additional layer covering the chamber or building the membrane itself if no further layer covers the chamber. This measure can be used to tailor the elastic and mechanical properties of the flexible membrane covering the chamber. In addition there can be a chamber electrode within the chamber facing the flexible membrane. If a voltage is applied between the actuation electrode and the moveable electrode a voltage can at the same time or a different time be applied between the actuation electrode and the chamber electrode. The part of the actuation electrode extending above the flexible membrane or even building the flexible membrane and the chamber electrode build an electrostatic actuator pulling the flexible membrane into the chamber if a voltage is applied in addition to the pressure that is applied to the flexible membrane via the pressure applicator as described above. This additional electrostatic actuator can be used to enlarge the force that can be applied to the flexible membrane.

The moveable electrode can be a part of a conductive substrate being directly attached to the pressure applicator that means there is a direct physical contact between the moveable electrode and the pressure applicator or the moveable electrode being a part of a conductive substrate can be indirectly attached to the pressure applicator if there is e.g. at least one isolating layer between the pressure applicator and the conductive substrate in order to improve or even guarantee the isolation between the actuation electrode and the moveable electrode. In an alternative embodiment the moveable electrode can be directly or indirectly attached to a carrier substrate. If the moveable electrode is directly attached to the carrier substrate the moveable electrode does have a direct physical contact with the carrier substrate and the carrier substrate is preferably made of electrically isolating material in order to reduce unwanted parasitic effects as parasitic capacitance. If the moveable electrode is indirectly attached to the carrier substrate at least one layer separates the moveable electrode and the carrier substrate. This at least one separating layer is preferably an electrically isolating layer reducing unwanted parasitic effects if the carrier substrate consists of a conductive material. The stiff carrier substrate with or without isolating layer provides the power transmission between the moveable electrode and the pressure applicator.

In a further embodiment the moveable electrode is directly or indirectly linked by means of elastic guides with a structure directly or indirectly attached in an essentially inflexible way to the chamber walls. The moveable electrode or the carrier substrate with the moveable electrode is connected by means of spring like structures (elastic guides) with a kind of suspension being in direct or indirect contact with the chamber walls. This kind of spring suspension directly or indirectly connected with the inelastic (in comparison to the elastic guides) chamber walls provides a stabilization of the moveable electrode in order to improve the reliability of the electrostatic actuator. Direct connection means that the structure building the suspension does have a direct physical contact with the chamber walls. Indirect means there is at least one intermediate layer between the structure building the suspension and the chamber walls. In addition to the reliability aspects the elastic guides exert a force to pull back the flexible membrane via the pressure applicator after a voltage is applied to the moveable electrode and the actuation electrode due to the stress in the material whereof the elastic guides consist of. One special embodiment to realize the flexible guides is a flexible layer of at least one material that extends between the moveable electrode or the carrier substrate where the moveable electrode is attached to and the structure building a kind of suspension for the moveable electrode or the carrier substrate where the moveable electrode is attached to. The material or materials and the thickness of the layer or layers can be adapted in a way that on the one hand the pull back force exerted by the elastic guides is sufficient to pull back the flexible membrane but on the other side the pressure that can be exerted by the flexible membrane is not reduced in a decisive way. The pull back force has to be small in comparison to the force that can be exerted by the electrostatic actuator built by the moveable electrode and the actuation electrode. A further measure to adapt the mechanical properties of the flexible guides is to structure the layer or layers connecting the moveable electrode (or the carrier substrate where the moveable electrode is attached to) and the structure building a kind of suspension for the moveable electrode (or the carrier substrate where the moveable electrode is attached to). This structuring results in flexible, bridge like structures building the flexible guides. This method can also be used if the moveable electrode (or the carrier substrate where the moveable electrode is attached to) and the structure building a kind of suspension for the moveable electrode (or the carrier substrate where the moveable electrode is attached to) are made from one bulk material. In this case the material between the moveable electrode (or the carrier substrate where the moveable electrode is attached to) and the structure building a kind of suspension for the moveable electrode (or the carrier substrate where the moveable electrode is attached to) is thinned down in order to build the flexible guides. The structuring of this thinned material between the moveable electrode (or the carrier substrate where the moveable electrode is attached to) and the structure building a kind of suspension for the moveable electrode (or the carrier substrate where the moveable electrode is attached to) can again be used to adapt the mechanical properties of the flexible guides by building flexible, bridge like structures.

It is a further objective to provide a printing system comprising an electrostatic actuator for high-pressure ejection.

The printing system comprises an electrostatic actuator according to the present invention. The electrostatic actuator is implemented in the print head of the printing system in order to eject ink with high pressure for high-quality printing.

It is a further objective of the current invention to provide a method for driving an electrostatic actuator for high-pressure ejection of fluids.

The electrostatic device comprises a chamber, with at least one opening, a flexible membrane being part of the boundary of the chamber, at least one actuation electrode, at least one moveable electrode, a pressure applicator coupling the movement of the flexible membrane and the moveable electrode, and a voltage source to apply a voltage between the moveable electrode and the actuation electrode. The method to drive the electrostatic actuator comprises the following steps:

- applying a voltage between the moveable electrode and the actuation electrode;
- actuating the moveable electrode;
- transferring the movement of the moveable electrode by means of the pressure applicator to the flexible membrane;
- applying a force to a fluid to be ejected filled in the chamber by means of the flexible membrane;
- ejecting the fluid to be ejected filled in the chamber through an opening.

The force applied to the fluid to be ejected increase the pressure in the chamber causing the ejection of the fluid to be ejected. A second opening can be provided in order to refill the chamber by means of an e.g. tube connecting the chamber with a reservoir filled with the fluid to be ejected. The chamber is refilled with the fluid to be ejected by means of an under inflation in the chamber caused by the elastic properties of the flexible membrane pulling back the flexible membrane if no force is applied to the flexible membrane. If elastic guides are provided the pull back force is supported depending on the elastic properties of the elastic guides.

It is further an objective of the current invention to provide a device with an electrostatic actuator for high-pressure ejection.

The device with the electrostatic actuator can be an ejector or a pump. The device can be used to eject or pump a fluid through the at least one opening of the chamber. The chamber can be filled with the fluid by means of a supply pipe connecting a reservoir filled with the fluid with a second opening of the chamber. After the chamber is filled with the fluid a voltage is applied to the actuation electrode and the moveable electrode and a force is exerted by means of the pressure applicator to the flexible membrane enhancing the pressure of the fluid in the chamber finally resulting in the ejection of the fluid through the at least one opening in this case the first opening of the chamber, whereby the opening preferably is a nozzle. The chamber can then be refilled through the supply pipe using the pull back of the flexible membrane by means of the stress of the flexible membrane or additionally by means of the elastic guides and optionally in combination with a pressure applied to the fluid reservoir. In addition means as valves can be set aside for closing the opening where the fluid is ejected during the refilling of the chamber. The electrostatic actuator can be used for transdermal drug delivery, printing circuits or printing polyLED. At least one opening of the chamber is then characterized by being a nozzle and the fluid is a liquid drug or a liquid solution with a drug, a liquid conductor or a polymer. The electrostatic actuator can also be used to eject ink in a printing system. Again at least one opening of the chamber is then characterized by being a nozzle and the fluid is ink. Further the electrostatic actuator can be used as a pump. In this case there are at least two openings one where the fluid flows in and one where the fluid flows out. Additional means as valves close the opening where the fluid flows out as long as the opening, where the fluid flows in, is open and vice versa. Further pipes can be connected to additional openings in order to pump the fluid.

The present invention will now be explained in greater detail with reference to the figures, in which similar parts are indicated by the same reference signs, and in which:

FIG. 1 shows a principal sketch of one embodiment of the electrostatic actuator FIG. 2 shows the area of the membrane covering the chamber and the electrostatic active area of the moveable electrode FIG. 3*a*-3*e* show the processing of the wafer comprising the moveable electrode FIG. 4*a*-4*e* show the processing of the wafer comprising the membrane FIG. 5*a*-5*b* show the assembly of the two wafers FIG. 6*a*-6*e* show further processing of the assembled wafers FIG. 7 shows an alternative embodiment of the assembled wafers shown in FIG. 6*e*

Figure 1:
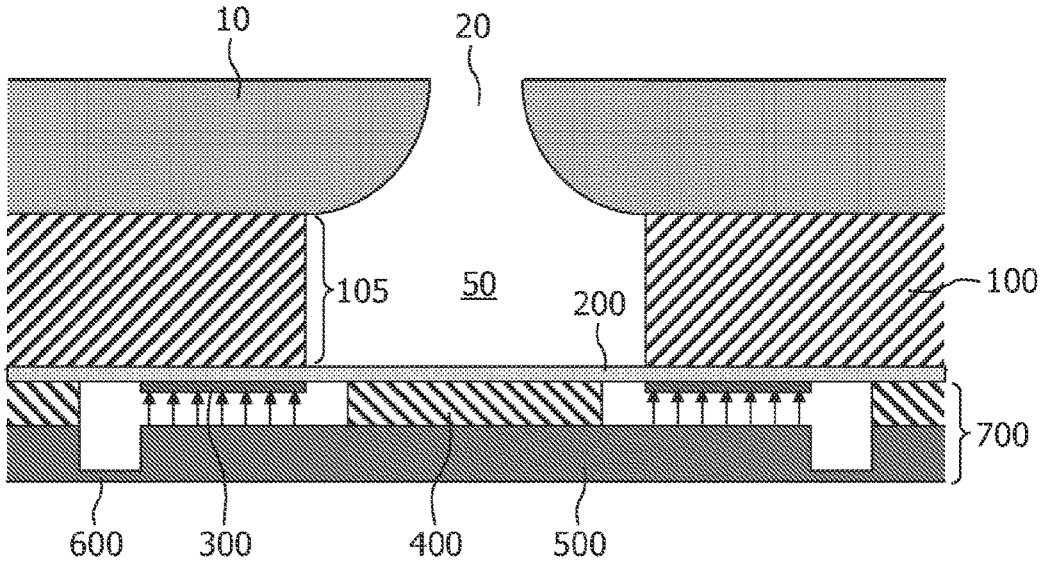
Figure 10:
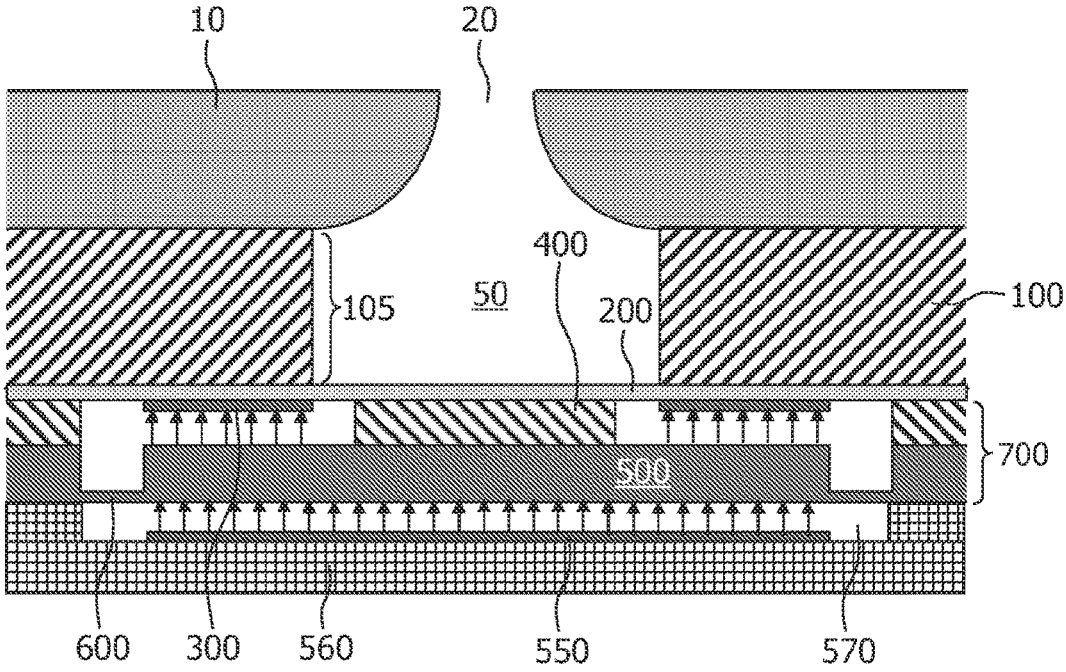

FIG. 10 shows a principal sketch of a further embodiment of the electrostatic actuator FIG. 1 shows a cross section where the principal structure of one embodiment of the electrostatic actuator is depicted. A layer 10 with an opening 20 is attached to a further layer 100 with a chamber 50. The material where the layer 100 consists of builds the chamber walls 105 of the chamber 50. The opening 20 in the layer 10 is placed in a way that it is an opening of the chamber 50. Further there is a membrane 200 covering the chamber on the opposite site with respect to the opening 20. The membrane 200 extends across the whole layer 100. A pressure applicator 400 is attached to the membrane 200 where the membrane 200 covers the chamber 50. The actuation electrode 300 is also attached to the membrane 200 essentially around the area of the membrane 200 covering the chamber 50. Further a suspension 700 being electrically isolated from the actuation electrode 300 is attached to the membrane where on the other side of the membrane the layer 100 is attached to the membrane 200 whereof the chamber walls 105 of the chamber 50 consist of. The moveable electrode 500 is attached to the pressure applicator 400 on the one side and to the suspension 700 via the elastic guide or guides 600 on the other side. The elastic guide or guides 600 consists of the same material as the moveable electrode 500 and at least a part of the suspension 700. The material is thinned down and possibly structured building bridge like elastic guides (not visible in the cross section). If a voltage is applied between the actuation electrode 300 and the moveable electrode 500 the resulting attractive force between the actuation electrode and the part of the moveable electrode facing the actuation electrode is applied via the pressure applicator 400 to the membrane 200 covering the chamber 50. The part of the membrane 200 covering the chamber 50 deforms and exerts a pressure to a fluid that can be filled in the chamber 50 (supply pipe and fluid reservoir are not shown). The pressure in the chamber 50 causes the ejection of the fluid via the opening 20.

Figure 2:
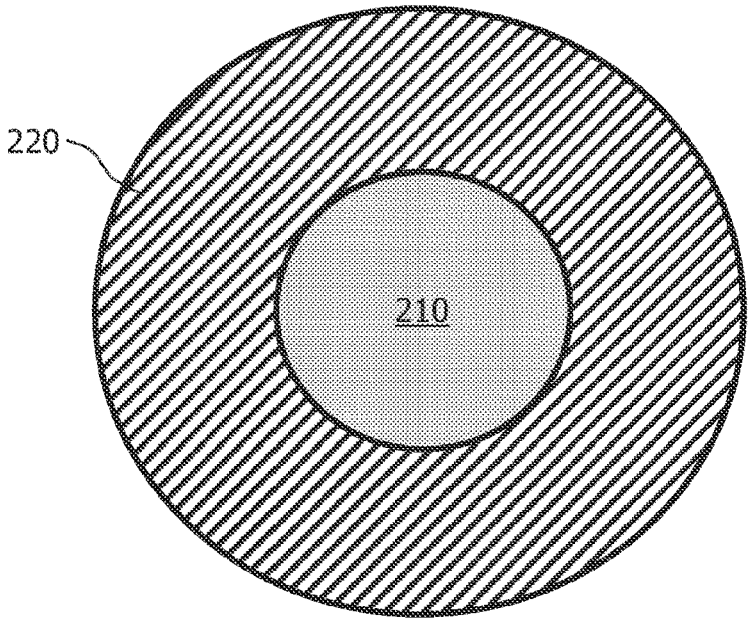

FIG. 2 shows the area 210 of the membrane 200 covering the chamber 50 and the electrostatic active area 220 of the moveable electrode 500. The pressure that can be applied to the membrane 200 via the pressure applicator 400 is essentially determined by the ratio of the areas 220 and 210. The bigger the electrostatic active area 220 is in comparison to area 210 the higher is the maximum pressure that can be applied to the membrane 200 and finally to the fluid in the chamber 50.

Figure 3A:
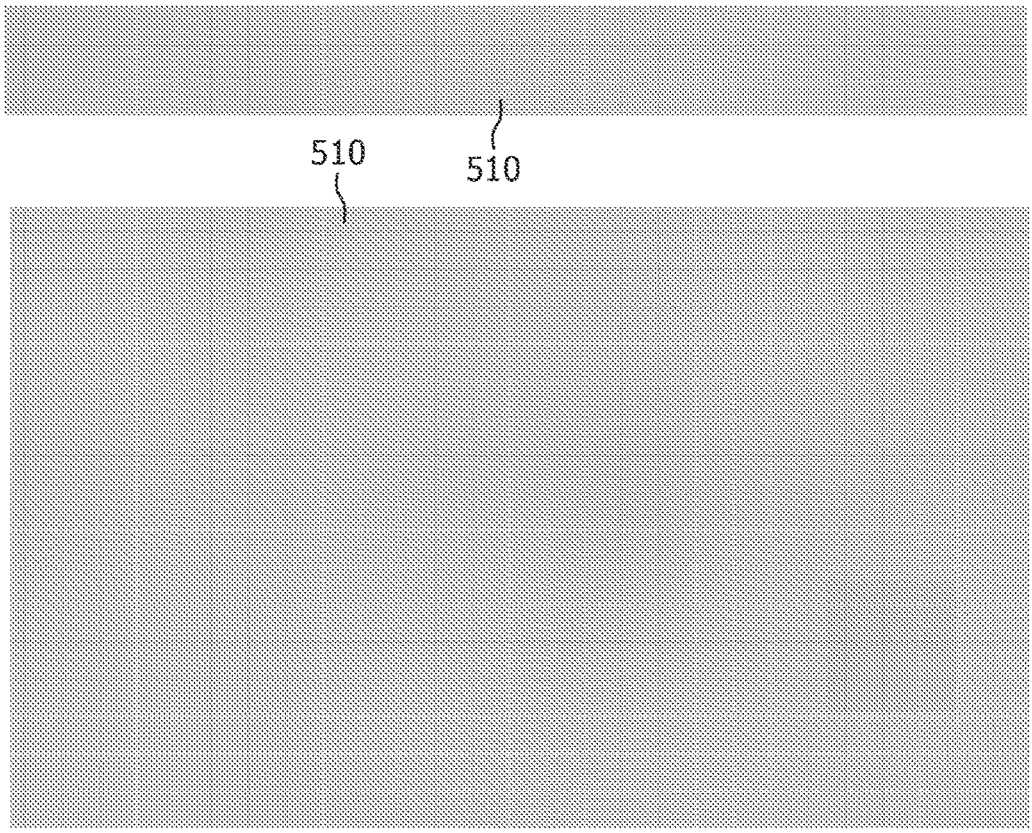
Figure 3B:
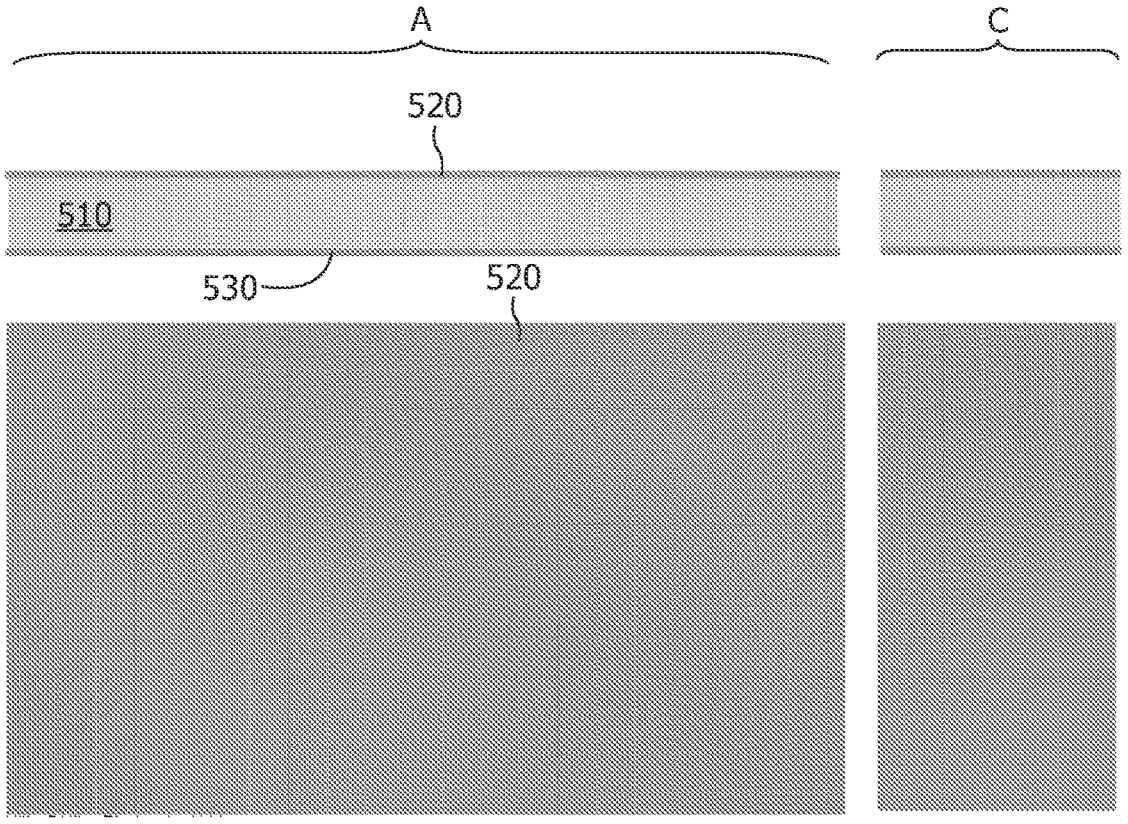
Figure 3C:
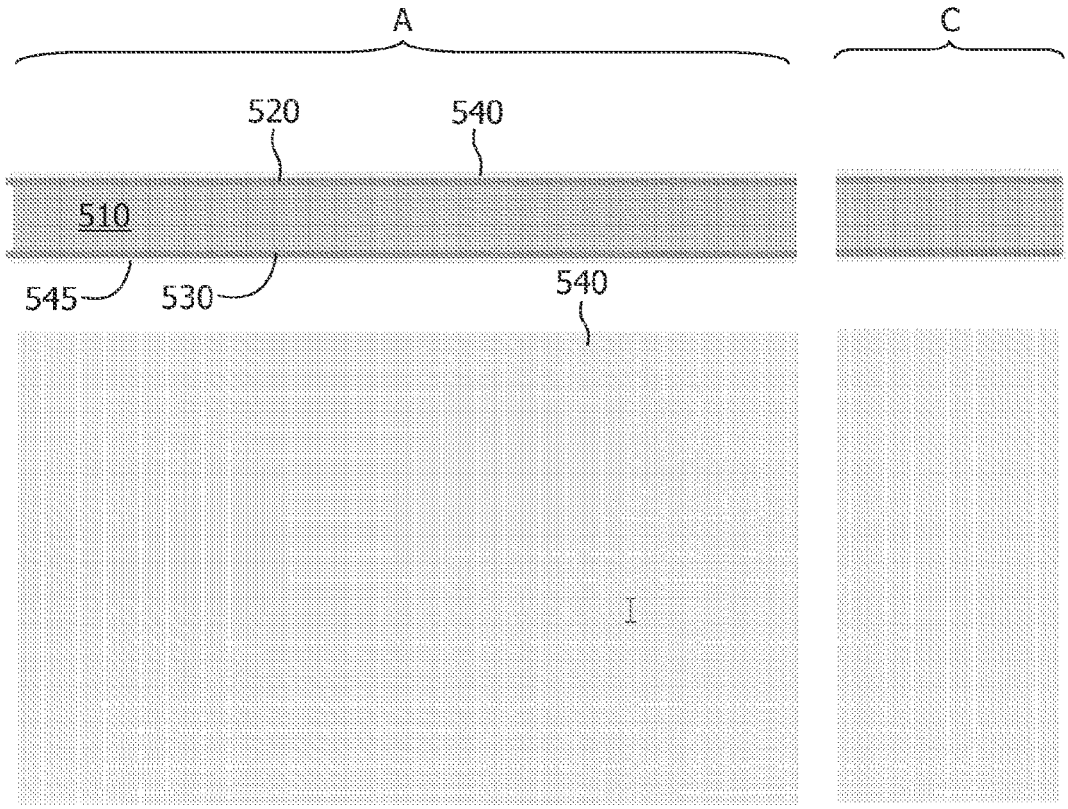
Figure 3D:
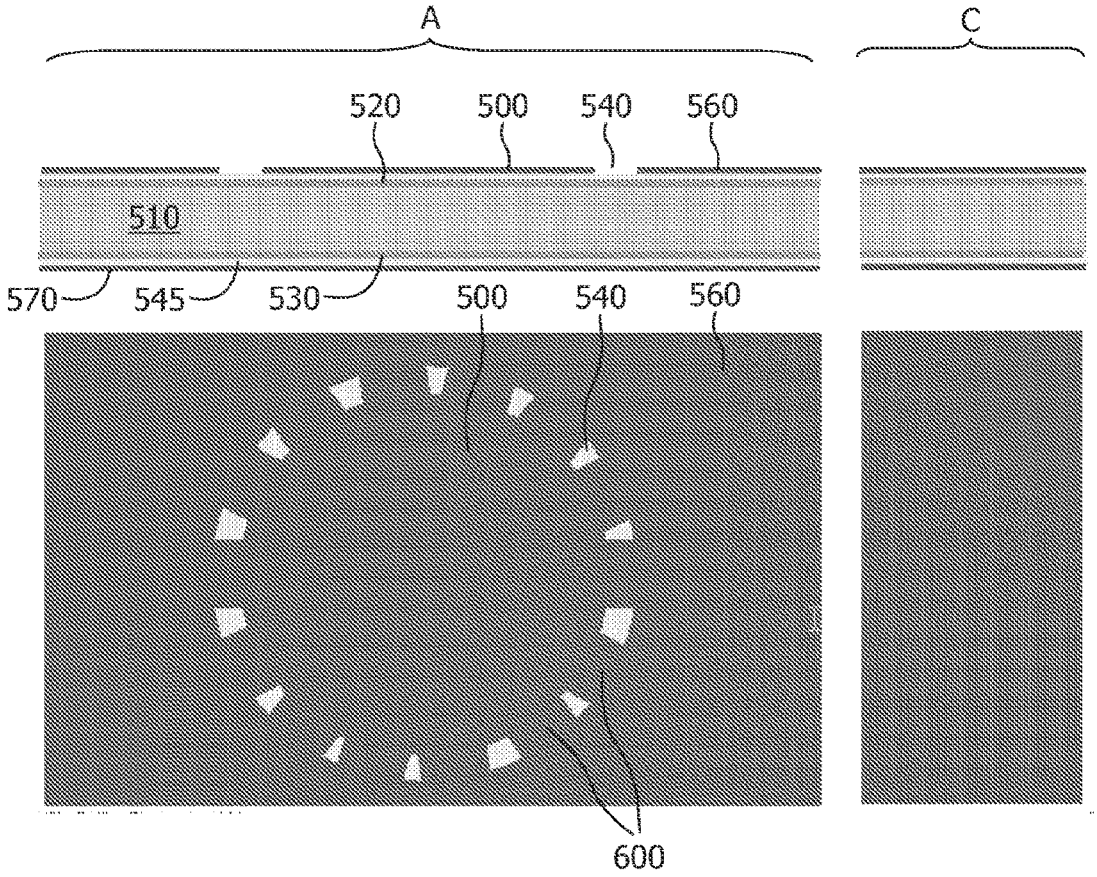
Figure 3E:
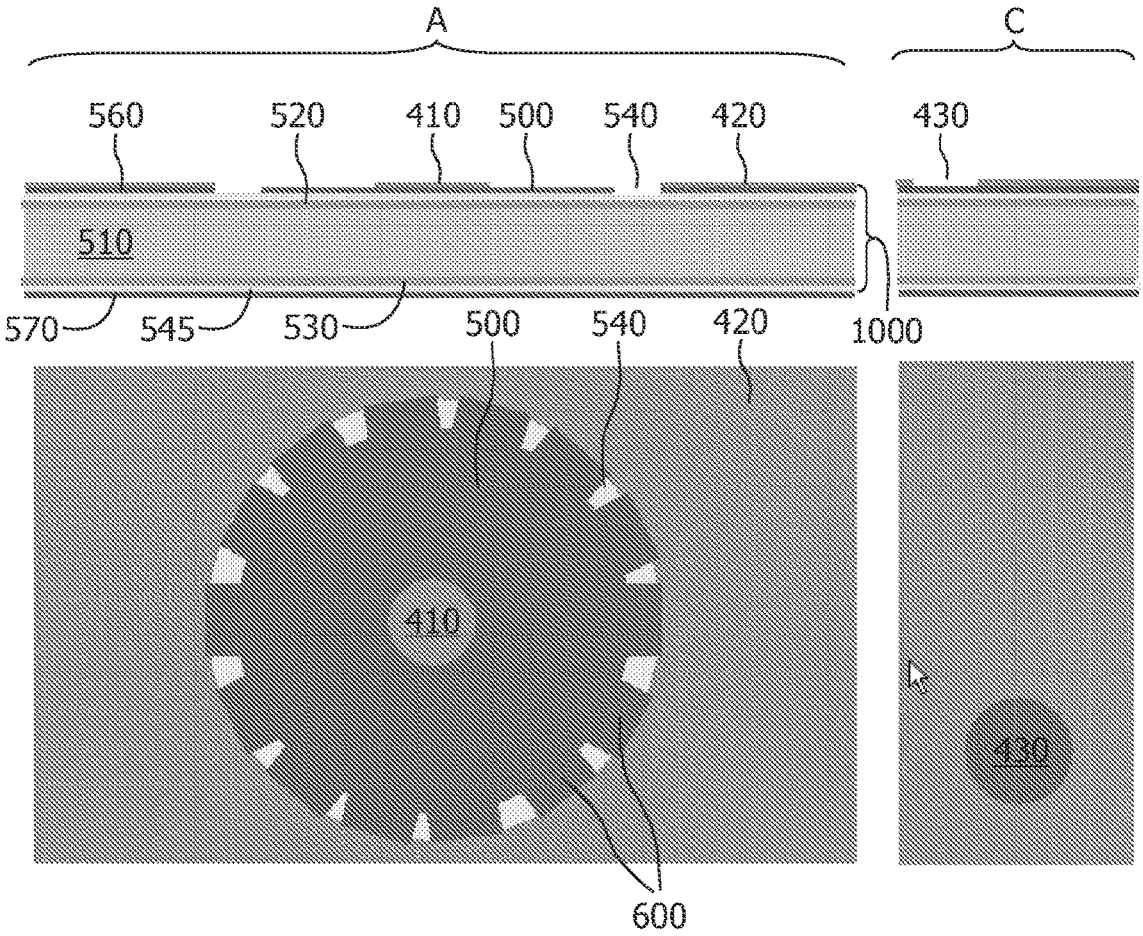

FIG. 3*a*-3*e* shows part of the processing of the electrostatic device. The upper part of the Figures shows a cross section and the lower part of the Figures a top view of the wafer with respect to the cross section. On a first double side polished Si wafer 510 with a thickness of around 400 μm as shown in FIG. 3*a* two layers 520 and 530 of thermal $SiO_2$ with a thickness of around 0.25 μm are grown as depicted in FIG. 3*b*. FIG. 3*b* further shows the part of the wafer A where the electrostatic device is located an part C where the electrical contacts of the electrostatic device are located. FIG. 3*c* shows the deposition of around 0.25 μm low stress LPCVD SiN on top of the layers of thermal oxide 520 and 530 whereby the top layer of low stress LPCVD SiN is denominated 540 and the bottom layer 545. The following FIG. 3*d* shows the process after depositing around 1.5 μm doped poly-Si on both sides of the wafer. The bottom layer 570 remains unstructured during this process step whereby the top poly-Si layer is structured resulting in an area building the moveable electrode 500 and isolated areas 540 placed around the moveable electrode 500 where the poly-Si is etched away and the low stress LPCVD is visible. The poly-Si between these isolated areas 540 finally builds the elastic guides 600. These elastic guides 600 electrically connect the moveable electrode 500 with the outer region 560 of the poly-Si being again electrically connected with the contact region C. In the following process step depicted in FIG. 3*e* 0.5 μm photo BCB is deposited on the top side of the wafer 510 on top of the structured poly-Si layer and structured. A circular patch 410 is left in the middle of the moveable electrode 500 and in addition the residual BCB 420 covers the outer region 560 of the structured poly-Si layer. Further an opening 430 is formed in the contact region C to enable the contact to the poly-Si. The processed wafer is denominated 1000.

Figure 4A:
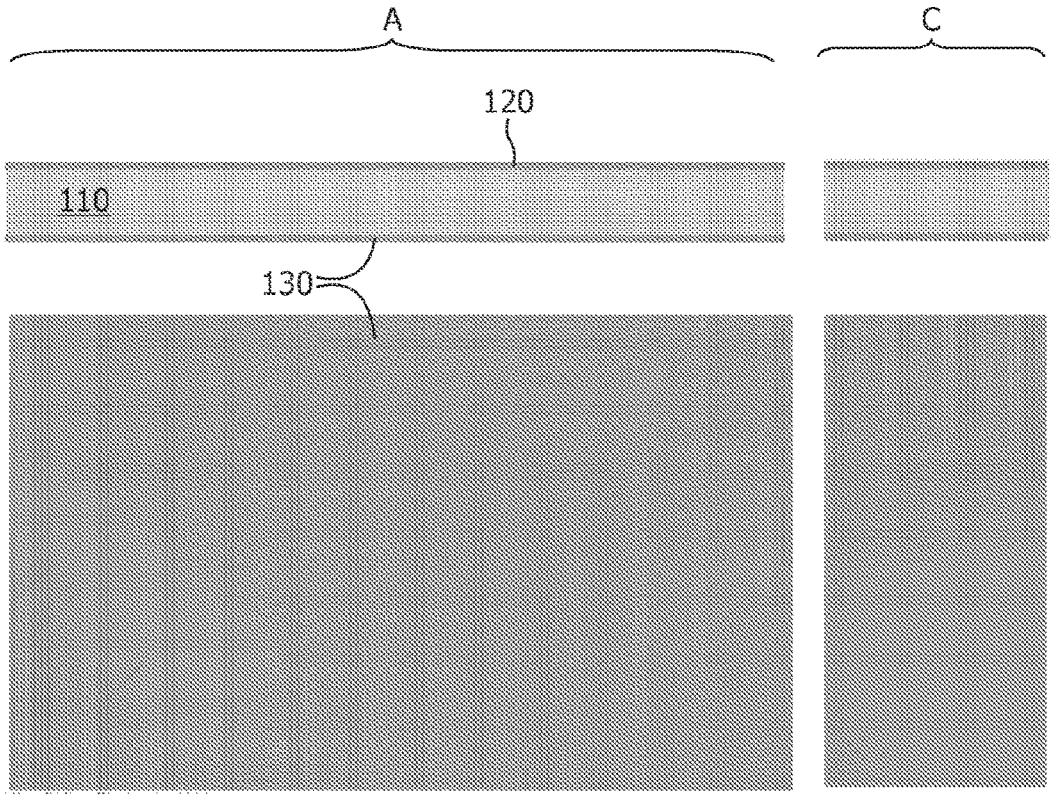
Figure 4B:
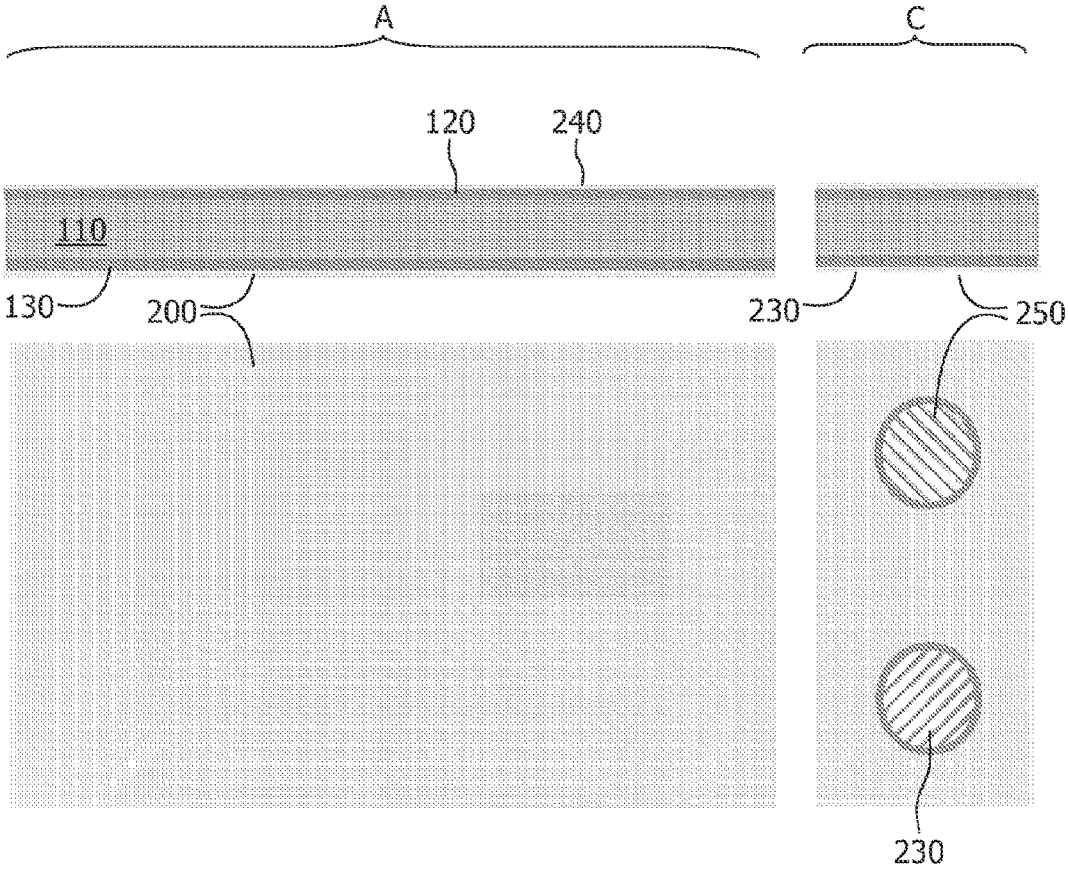
Figure 4C:
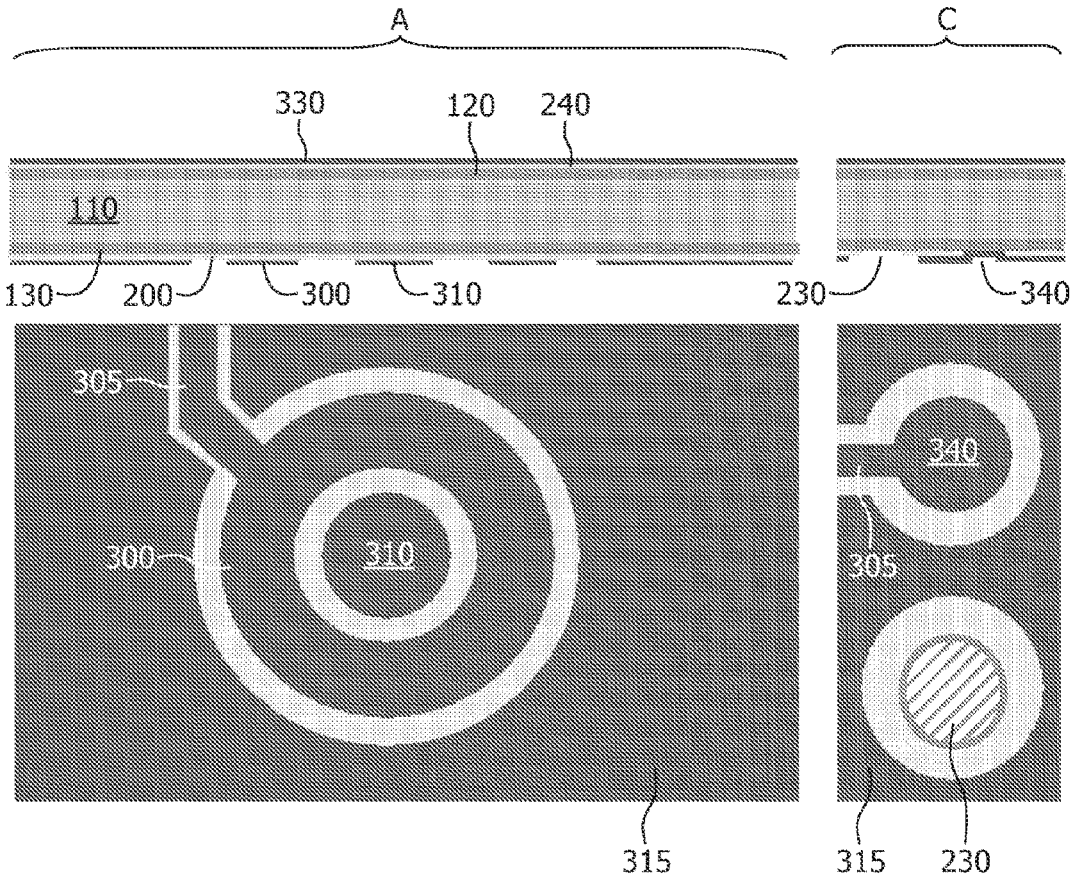
Figure 4D:
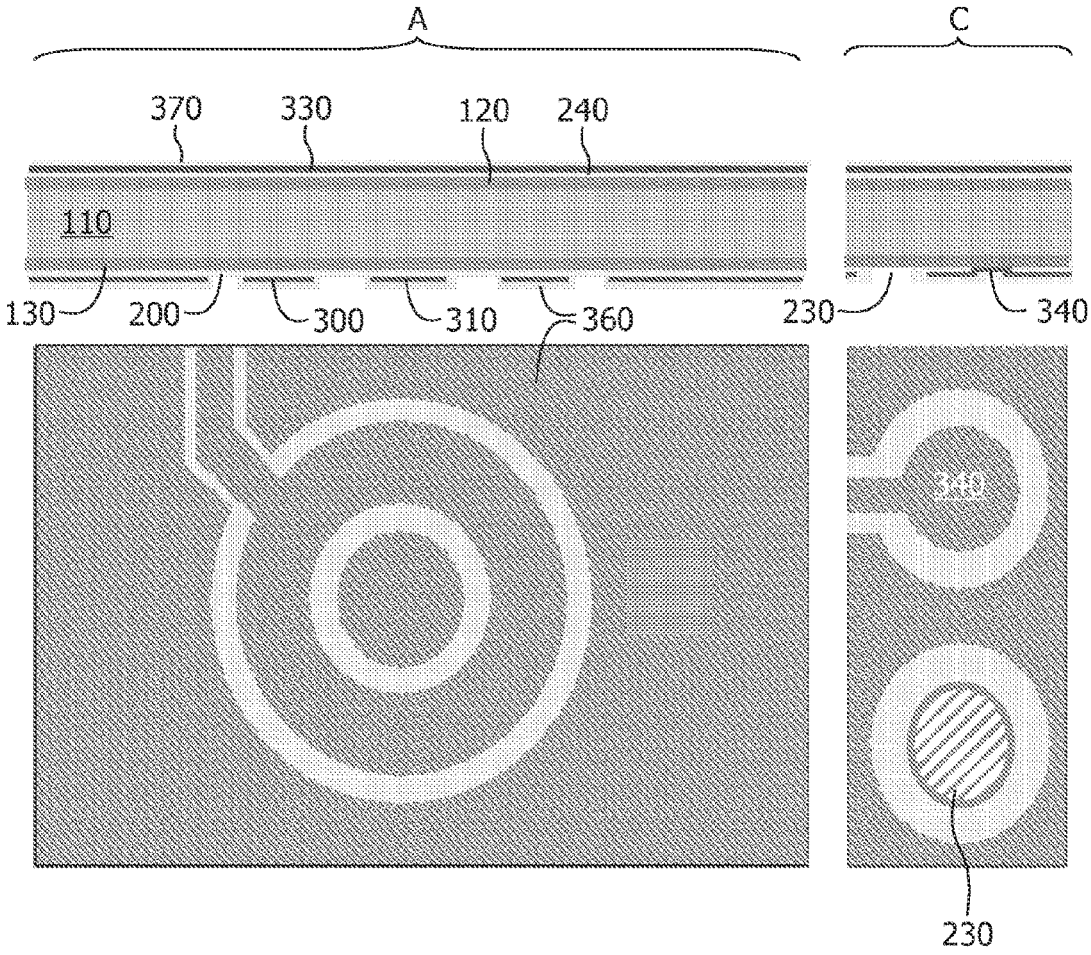
Figure 4E:
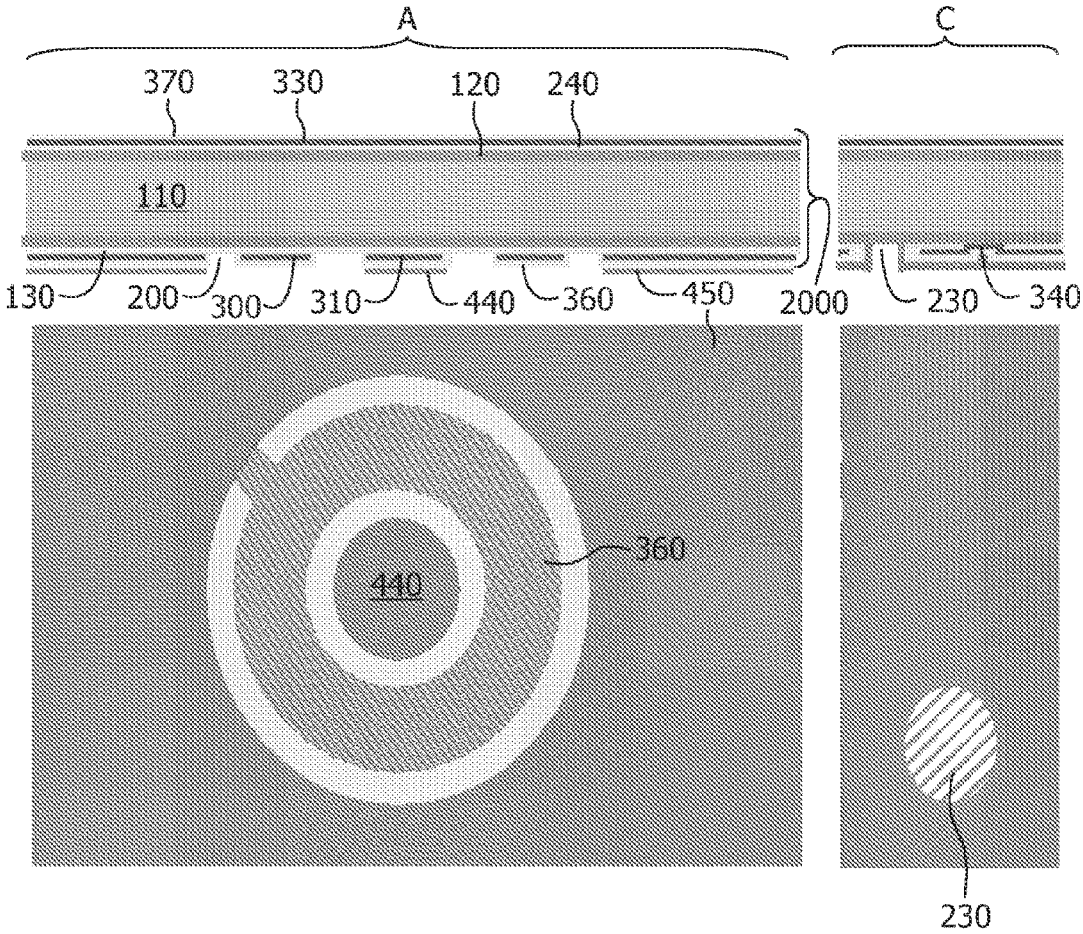

FIG. 4*a*-4*e* show a further part of the processing of the electrostatic device. The upper side of the Figures shows a cross section of the wafer in the different process steps and the lower part of the Figures shows the bottom side of the wafer with respect to the cross section. A refers again to the location of the electrostatic device and C refers again to the contact area. A second double side polished Si wafer 110 with a thickness of around 400 μm is covered on both sides with layers 120 and 130 of thermal $SiO_2$ with a thickness of around 0.25 μm as shown in FIG. 4*a*. FIG. 4*b* shows the following step of depositing two layers 200 and 240 of low stress LPCVD SiN with a thickness of around 0.25 on the layers 120 and 130. In addition the layer 200 is structured in a way that there are finally openings 230 and 250 through the SiN layer 200 in the contact area C. In the following process step shown in FIG. 4*c* around 1.5 μm doped poly-Si is deposited on top of the layers 200 and 240. The top layer 330 remains unstructured whereby the bottom layer is structured building the actuation electrode 300 and a connection 305 to the contact point 340 being electrically isolated from the part 315 of the doped poly-Si layer. Further there is an electrically isolated circular patch 310 of doped poly-Si surrounded by the actuation electrode 300. In the contact area C the poly-Si layer is structured in a way that opening 250 in the SiN layer 200 is filled with poly-Si building the contact electrode 340 connected with the actuation electrode 300 and being electrically isolated from the surrounding poly-Si 315. Further the poly-Si above the opening 230 in the SiN layer 200 is removed. In FIG. 4*d* the deposition of two layers 360 and 370 of around 0.25 μm low stress LPCVD SiN is shown. The SiN layer 370 is deposited on top of the poly-Si layer 330 and the SiN layer 360 is deposited on top of the structured parts 310, 300, 315, 340 and 305 of the bottom poly-Si layer and on top of the first bottom SiN layer 200 where the bottom poly-Si layer has been removed. In the contact area C the SiN layer 360 is partly removed and the opening 230 to the $SiO_2$ layer 130 is freely accessible. The second wafer 2000 is completed by the deposition and structuring of around 0.5 μm BCB on top of the second bottom SiN layer 360. The BCB layer is removed above and slightly around the actuation electrode 300 resulting in an isolated circular patch 440 of BCB and the residual BCB layer 450 (In a slight variation of the process flow there is no BCB layer on wafer 2000 only one BCB layer of around 1 μm on wafer 1000 or vice versa). The circular patch of BCB 440 has essentially the same size as the circular patch of BCB 410 on the top of the first wafer 1000. Also the residual BCB layer 450 fits to the residual BCB layer 420 on top of the first wafer 1000. Again removing a part of the BCB opens the opening 230 in the contact area C.

Figure 5A:
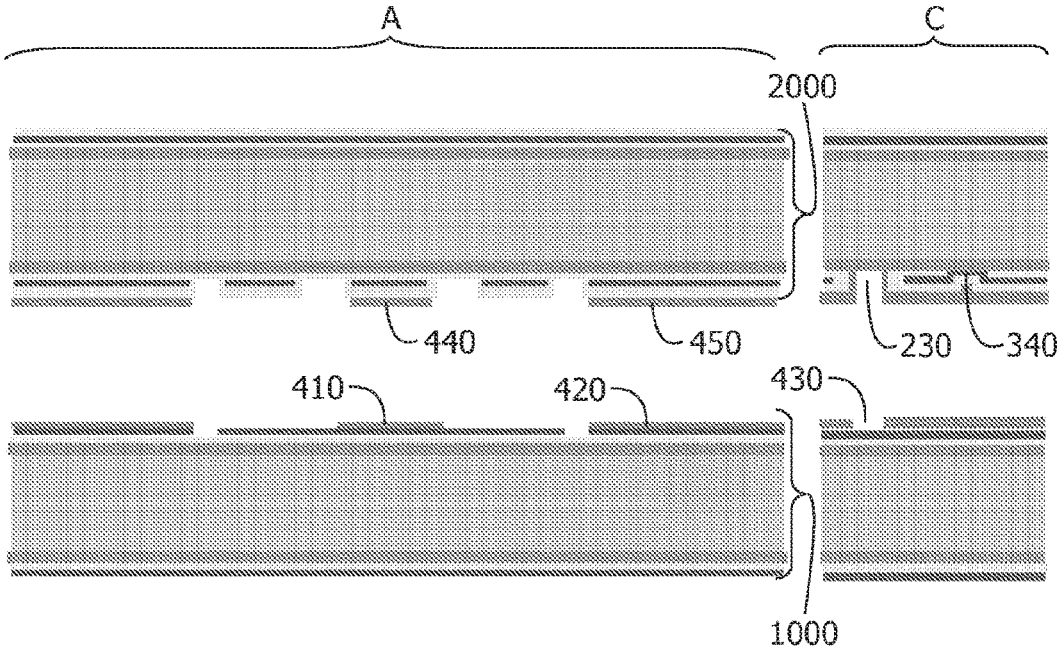
Figure 5B:
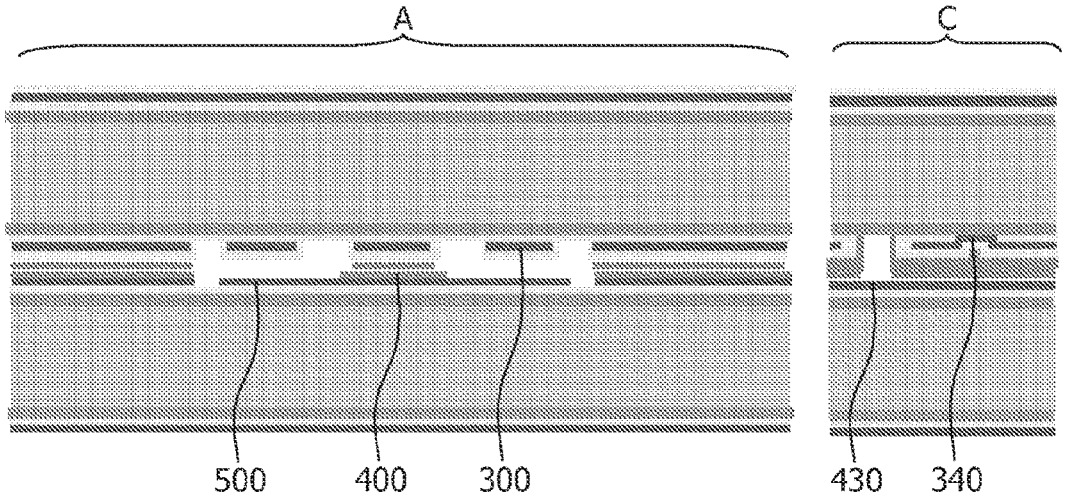

FIGS. 5*a* and 5*b* show the bonding process of the two wafers 1000 and 2000. Wafer 1000 and wafer 2000 are placed in a way that the circular patch of BCB 440 on the bottom side of the wafer 2000 is aligned with the circular patch 410. In addition the residual BCB layer 450 on the second wafer 2000 and the residual BCB layer 420 on the first wafer 1000 as well as the openings 230 on the second wafer 2000 and the opening 430 on the first wafer 1000 are aligned as shown in FIG. 5*a*. After the alignment the wafers 1000 and 2000 are pressed together. The application of heat and pressure results in a strong bonding of the two BCB layers placed on each other as shown in FIG. 5*b*. The circular patches 410 and 440 are joined with each other building the pressure applicator 400 indirectly attached to the SiN layer 200 via the SiN layer 360 on top of the electrically isolated circular patch 310 of poly-Si and the electrically isolated patch 310 of poly-Si.

Figure 6A:
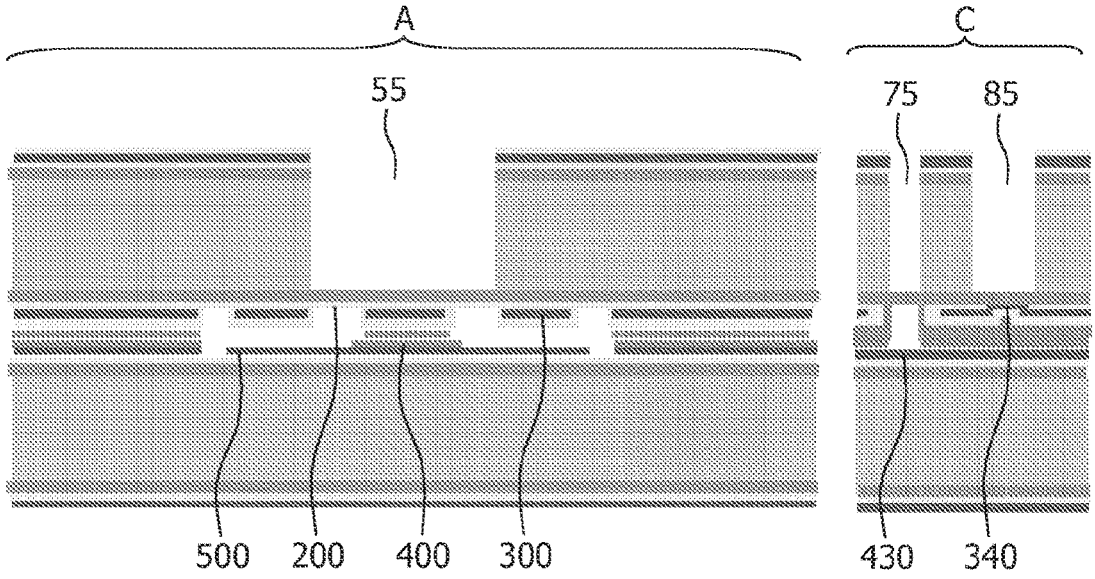
Figure 6B:
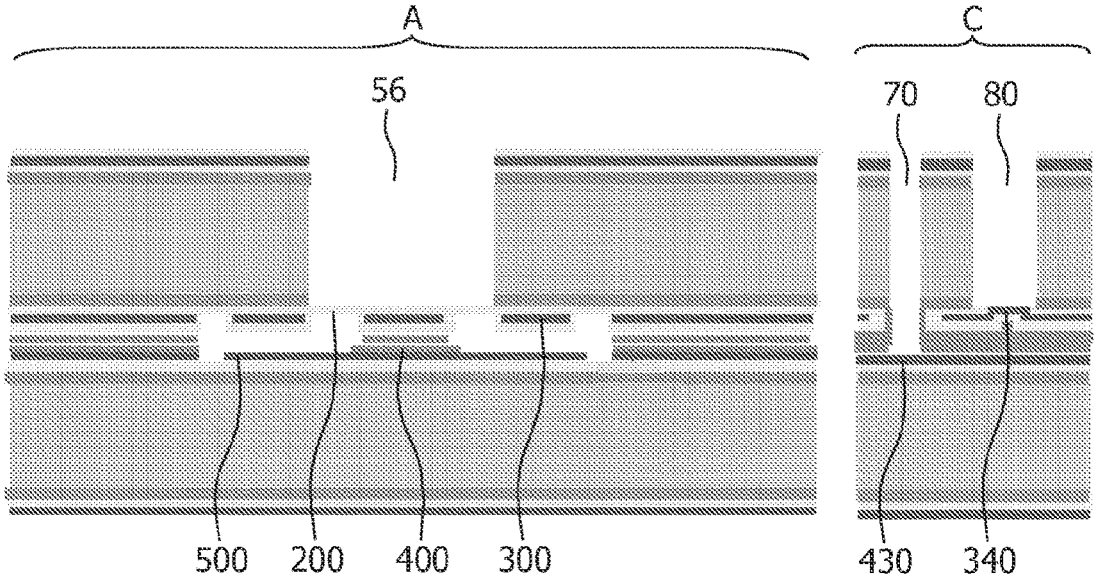
Figure 6C:
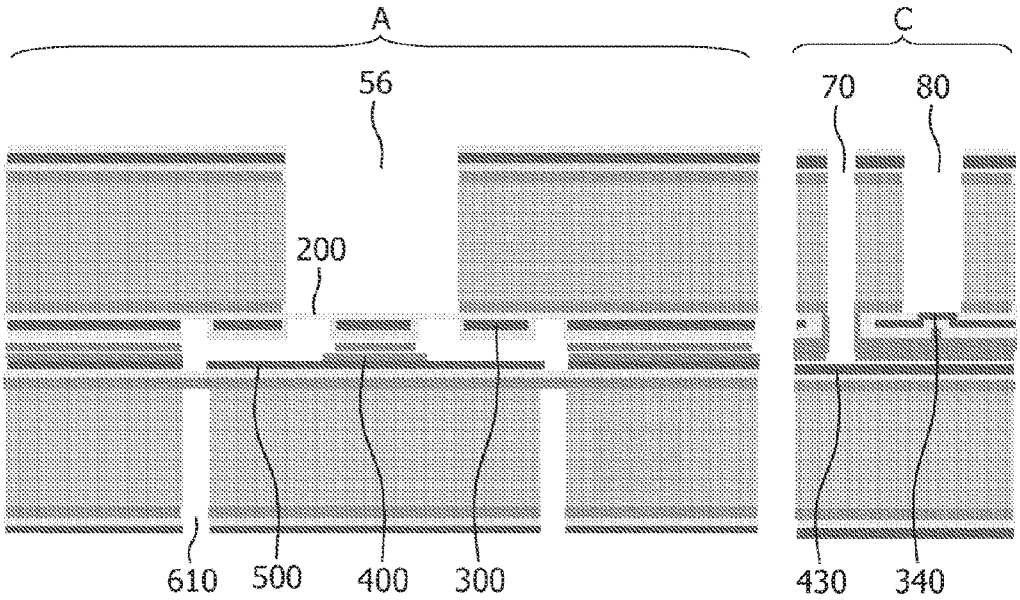
Figure 6D:
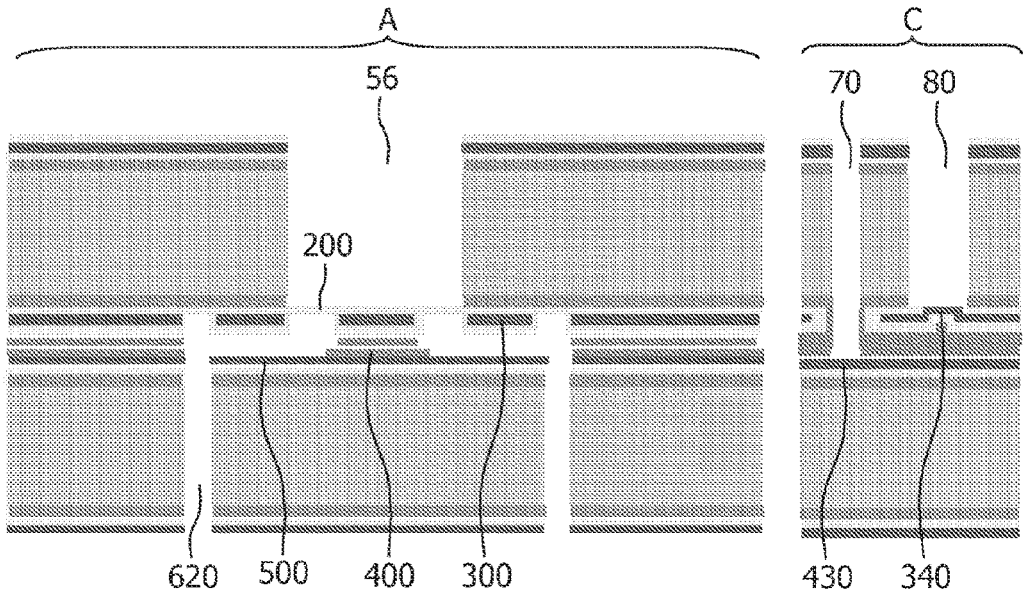
Figure 6E:
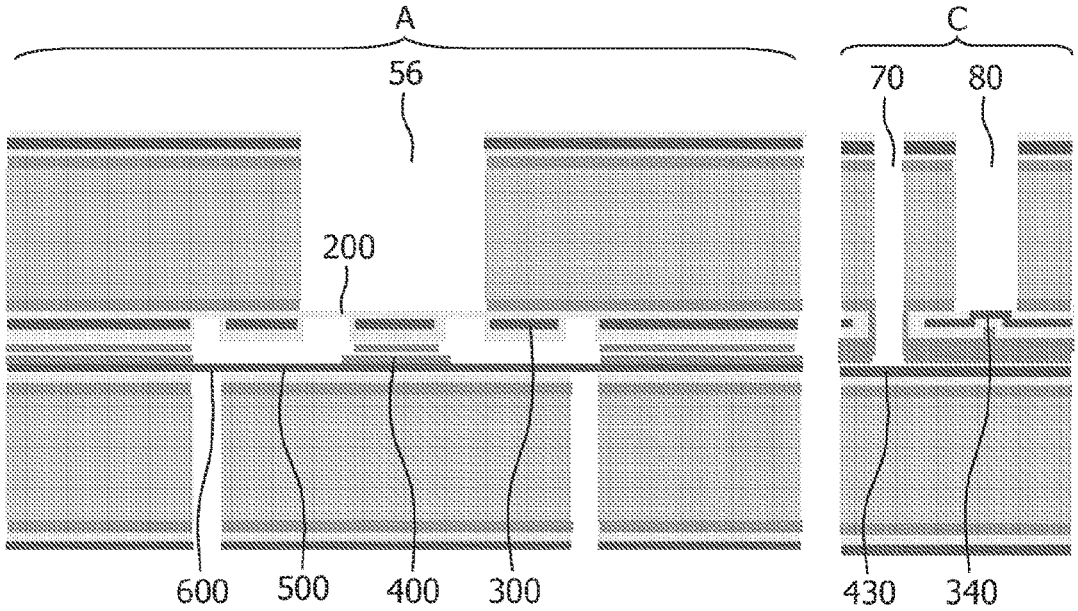

FIG. 6*a*-6*e* show the further processing of the stacked and bonded device as shown in FIG. 5*b*. FIG. 6*a* shows the structuring and removing of the top SiN layer 370, the top poly-Si layer 330, the second SiN layer 240 and the thermal $SiO_2$ layer 120 of the wafer 2000 and the following deep reactive ion etch (DRIE) of the Si wafer 110 stopping on top of the bottom thermal $SiO_2$ layer 130 of the second wafer 2000. By means of this structuring and removing of the layers and the following DRIE-etch a first recess 55 is formed above the pressure applicator 400 extending near to the border of the actuation electrode 300. Further two channels 75 and 85 are etched in the layers 370, 330, 240 and 120 and the Si wafer 110 above the contact points 340 and 430. In the following step shown in FIG. 6*b* the bottom $SiO_2$ layer 130 of the second wafer 2000 is etched in the first recess 55 and the channels 75 and 85. The recess 56 is built and in the contact area C the contact point 340 contacting the actuation electrode 300 is accessible via the channel 80 as well as the contact point 430 contacting the moveable electrode 500 is accessible via the channel 70. The SiN layer 200 accessible via the recess 56 builds the flexible membrane 200 of the electrostatic device FIG. 6*c* shows an intermediate step of the release of the moveable electrode 500. The bottom poly-Si layer 570, the bottom SiN layer 545 and the bottom $SiO_2$ layer 530 of the first wafer 1000 are structured and etched followed by a DRIE etch of the Si wafer 510 stopping on the top SiO2 layer 520 of the first wafer 1000 following the border of the moveable electrode 500 in a ring shape groove 610 above the flexible guides 600 shown in the top views of FIG. 3*d* and 3*e*. In the following step shown in FIG. 6*d* the top $SiO_2$ layer 520 and the top SiN layer 540 are etched by means of reactive ion etch (RIE) building the ring shape groove 620, and the moveable electrode 500 is released only connected with elastic guides made of poly-Si to the suspension built by the stack of layers and the Si wafers on the left an right side of the moveable electrode 500. The elastic guides 600 are not visible in FIG. 6*d* since the cross section is along a line where the poly-Si is etched away. FIG. 6*e* shows a slightly turned view of the electrostatic device shown in FIG. 6*d* where the elastic guides of poly-Si are visible (see also top view in FIG. 3*d* and 3*e*). In an alternative embodiment the SiN layer 540 is not etched. This results in a hermitically sealed space between the moveable electrode and the actuation electrode.

Figure 7:
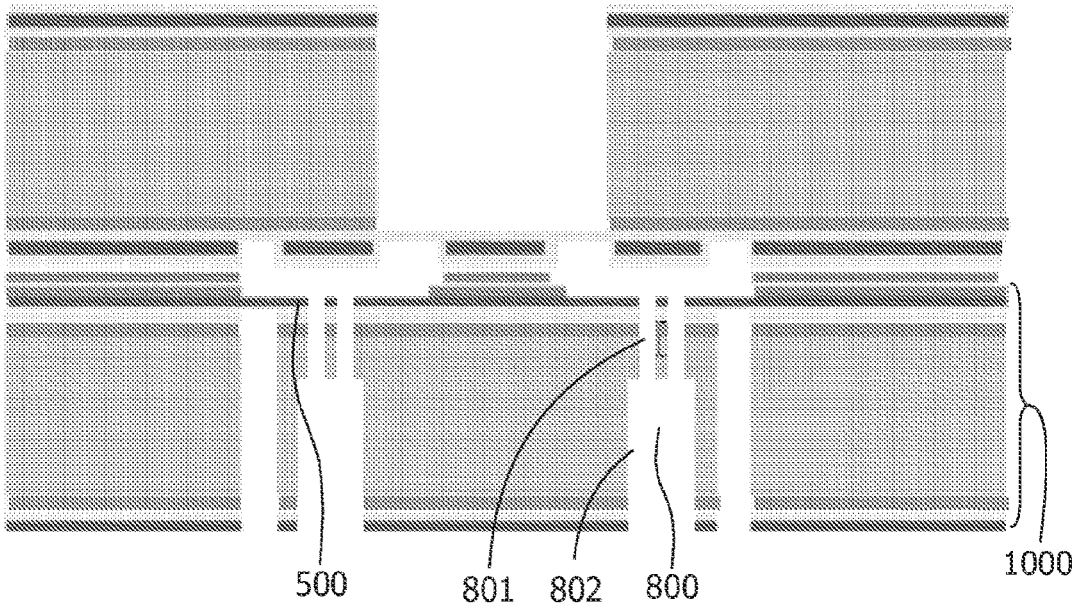

FIG. 7 shows an alternative embodiment of the assembled wafers shown in FIG. 6*e*. Additional venting channels 800 are etched in the first wafer 1000 in the area of the moveable electrode 500. These venting channels reduce air damping and the mass of the substrate where the moveable electrode 500 is attached to, enabling a higher speed of the moveable electrode. The venting channels consists of small channels 801 with a diameter of around 5 μm etched after the process step shown in FIG. 3*c* and bigger channels 802 with a diameter of around 50 μm etched together with the ring shaped groove 610 shown in FIG. 6*c*. The depth of the channels can be controlled by means of the ratio of the diameter of the channel and the width of the ring shaped groove 610. The bigger the diameter the deeper the channels etched in a certain time (not factored in in FIG. 7).

Figure 8:
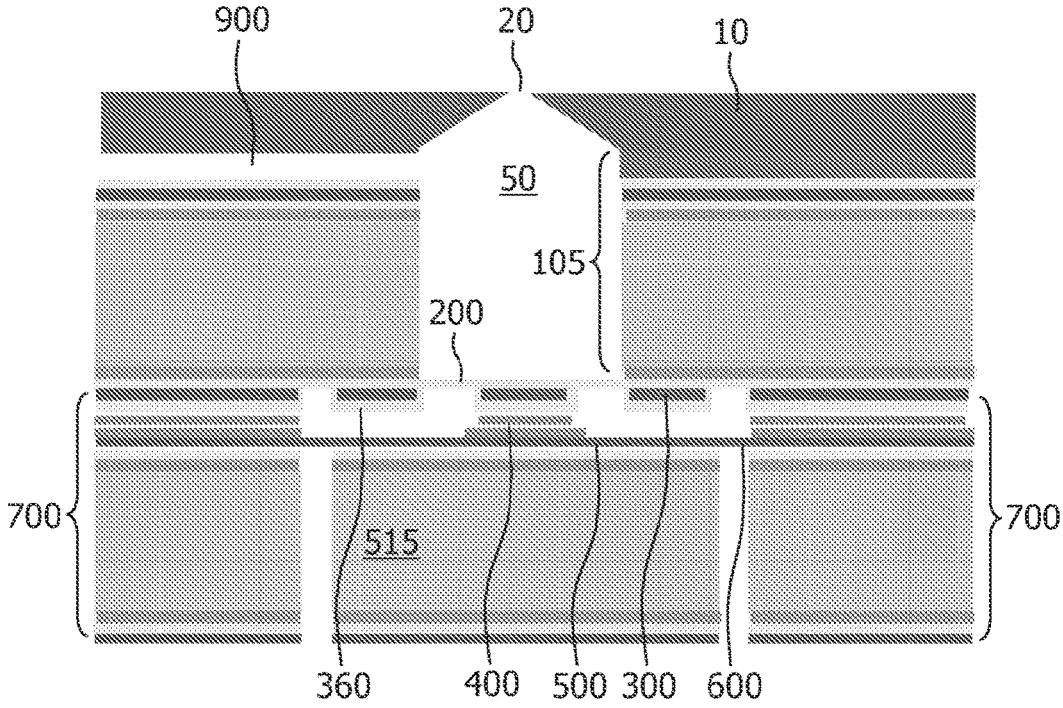
FIG. 8 shows the assembly of the nozzle

FIG. 8 shows in a further step the assembly of a substrate 10 with an opening (or nozzle) 20 and a recess 900 connected to the opening 20 that is glued or bonded to the top of the electrostatic device as shown in FIG. 6*e*. The substrate 10 can be processed by means of semiconductor technology as a separate wafer similar to the processing of wafers 1000 and 2000. FIG. 7 also shows the suspension 700 on the left and the right side of the moveable electrode 500 formed by the stack of layers below the membrane layer 200. This suspension is indirectly attached to the stack of materials whereof the chamber walls 105 above the membrane 200 consist of. The chamber 50 is built by means of the recess 56 and the substrate 10. The moveable electrode 500 is indirectly attached to a carrier substrate 515 formed by a part of the silicon wafer 510. The actuation electrode 300 and the moveable electrode 500 are separated by means of the SiN layer 360 on top of the actuation electrode 300. The joined circular patches of BCB 410 and 420 build the pressure applicator 400 indirectly attached to the flexible membrane 200.

Figure 9:
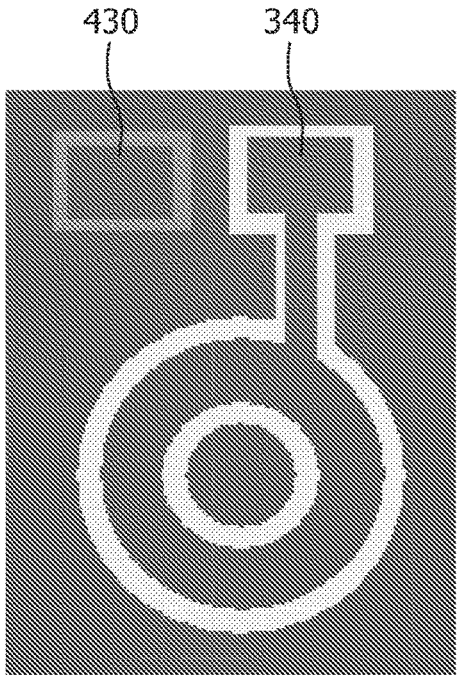
FIG. 9 shows the electrical contacts of the electrostatic actuator

FIG. 9 shows the electrical contact points 430 and 340 where the voltage can be applied to the actuation electrode and the moveable electrode.

FIG. 10 shows a cross section where the principal structure of a further embodiment of the electrostatic actuator is depicted. A layer 10 with an opening 20 is attached to a further layer 100 with a chamber 50. The material where the layer 100 consists of builds the chamber walls 105 of the chamber 50. The opening 20 in the layer 10 is placed in a way that it is an opening of the chamber 50. Further there is a membrane 200 covering the chamber on the opposite site with respect to the opening 20. The membrane 200 extends across the whole layer 100. A pressure applicator 400 is attached to the membrane 200 where the membrane 200 covers the chamber 50. A first actuation electrode 300 is also attached to the membrane 200 essentially around the area of the membrane 200 covering the chamber 50. Further a suspension 700 being electrically isolated from the first actuation electrode 300 is attached to the membrane where on the other side of the membrane the layer 100 whereof the chamber walls 105 of the chamber 50 consist of is attached to the membrane 200. The moveable electrode 500 is attached to the pressure applicator 400 on the one side and to the suspension 700 via the elastic guide or guides 600 on the other side. The elastic guide or guides 600 consists of the same material as the moveable electrode 500 and at least a part of the suspension 700. The material is thinned down and possibly structured building bridge like elastic guides 600 (not visible in the cross section). Further an electrically isolated back substrate 560 is attached to the backside of the suspension 700 building a cavity 570 between the moveable electrode 500 and the back substrate 560. A second actuation electrode 550 is attached to the back substrate 560 facing the moveable electrode 500 and the cavity 570 separates the moveable electrode 500 and the second actuation electrode 550. Optionally an isolating layer can be attached to the moveable electrode and/or the second actuation electrode 550 in order to prevent short circuits if a voltage is applied between the moveable electrode 500 and the second actuation electrode 550. The layer with the moveable electrode 500 is placed between the first actuation electrode 300 and the second actuation electrode 550. If a voltage is applied between the second actuation electrode 550 and the moveable electrode 500 the resulting attractive force between the second actuation electrode 550 and the moveable electrode 500 facing the second actuation electrode 550 is applied via the pressure applicator 400 to the membrane 200 covering the chamber 50. The part of the membrane 200 covering the chamber 50 is pulled outwards enlarging the volume of the chamber 50 and filling the chamber with a fluid to be ejected via a supply pipe connected to a fluid reservoir (not shown). Releasing the applied voltage between the moveable electrode 500 and the second actuation electrode 560 in a controlled way exerts a pressure to the fluid to be ejected due to the elastic properties of the membrane 200 and the elastic guide or guides 600. In addition a voltage is applied between the moveable electrode 500 and the first actuation electrode 300 attracting the moveable electrode towards the chamber 50 and pushing the membrane 200 inside the chamber 50 by means of the pressure applicator 400 further increasing the pressure in chamber 50. The pressure in the chamber 50 causes the ejection of the fluid via the opening 20. A simpler version of this embodiment comprises only the second actuation electrode 550. In this case the pressure exerted to the fluid to be ejected is mainly determined by the mechanical properties of the membrane 200 and the elastic guide or guides 600 since no additional electrostatic actuation (no first actuation electrode 300) increases the pressure in chamber 50 during the ejection of the fluid to be ejected.

The present invention is described with respect to particular embodiments and with reference to certain drawings but the invention is not limited thereto but only by the claims. Any reference signs in the claims shall not be construed as limiting the scope. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, first, second and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

The invention claimed is:

1. An electrostatic device, comprising a chamber (50) with at least one opening (20) on at least one side of the chamber (50), a flexible membrane (200) being part of the boundary of the chamber (50), at least one actuation electrode (300), at least one moveable electrode (500), a pressure applicator (400) coupling the movement of the flexible membrane (200) and the moveable electrode (500), and a voltage supply to apply a voltage between the actuation electrode (300) and the moveable electrode (500), wherein the moveable electrode is linked by elastic guides with a suspension structure attached to the chamber walls, such that the elastic guides exert a force to pull back the flexible membrane due to the stress in material that the elastic guides are made of.

2. An electrostatic device according to claim 1, wherein the electrostatic active area (220) of the moveable electrode (500) is bigger than the part of the area (210) of the membrane (200) being part of the boundary of the chamber (50).

3. An electrostatic device according to claim 1, wherein an isolating dielectric layer (360) is placed between the actuation electrode (300) and the moveable electrode (500).

4. An electrostatic device according to claim 1, wherein the actuation electrode (300) extends at least partly above the membrane (200).

5. An electrostatic device according to claim 1, wherein the moveable electrode (500) is directly or indirectly attached to a carrier substrate (515).

6. An electrostatic device according to claim 1, wherein the elastic guides (600) are realized by means of a flexible layer of at least one material.

7. An electrostatic device according to claim 1, wherein the elastic guides (600) are realized by means of flexible, bridge like structures.

8. The use of an electrostatic device according to claim 1 to eject a fluid through the at least one opening (20) of the chamber (50), wherein the fluid is ink used in printing systems.

9. The use of an electrostatic device according to claim 1 to eject a fluid through the at least one opening (20) of the chamber (50), wherein the fluid is a liquid drug used in an injection system.

10. A printing system comprising a fluid ejection device that includes: a chamber with at least one opening on at least one side of the chamber, a flexible membrane being part of the boundary of the chamber, at least one actuation electrode, at least one moveable electrode, a pressure applicator coupling the movement of the flexible membrane and the moveable electrode, and a voltage supply to apply a voltage between the actuation electrode and the moveable electrode, wherein the moveable electrode is linked by elastic guides with a suspension structure attached to the chamber walls, such that the elastic guides exert a force to pull back the flexible membrane due to the stress in material that the elastic guides are made of.

* * * * *